United States Patent [19]

Ogilvie

[11] Patent Number: 5,031,759

[45] Date of Patent: Jul. 16, 1991

[54] SOAP-HOLDING BAG

[76] Inventor: Greg Ogilvie, 14 Park Street, Brockville, Ontario, K6V 2G2, Canada

[21] Appl. No.: 496,284

[22] Filed: Mar. 20, 1990

[30] Foreign Application Priority Data

Sep. 29, 1989 [CA] Canada ..... 615228

[51] Int. Cl.[5] ..... B65D 30/06; B65D 33/01

[52] U.S. Cl. ..... 206/77.1; 383/72; 383/117

[58] Field of Search ..... 15/104 R, 105, 244.1, 15/244.3; 206/77.1; 383/72–76, 117

[56] References Cited

U.S. PATENT DOCUMENTS

| | | | |
|---|---|---|---|
| 731,378 | 6/1903 | Luther | 383/76 |
| 1,326,265 | 12/1919 | Hobbs | 15/244.3 |
| 2,152,697 | 4/1939 | Kingman | 15/244.3 |
| 2,457,918 | 1/1949 | Pierce | 206/77.1 |
| 2,832,116 | 4/1958 | Clevett, Jr. et al. | 383/74 |
| 2,946,074 | 7/1960 | Caldwell | 15/244.1 |
| 3,470,928 | 10/1969 | Schwartz | 383/117 |
| 4,047,259 | 9/1977 | Lotis | 15/244.3 |
| 4,196,534 | 4/1980 | Shibamoto | 383/117 |
| 4,659,495 | 4/1987 | Figliola | 206/77.1 |
| 4,733,426 | 3/1988 | George | 206/77.1 |
| 4,750,292 | 6/1988 | Alstig | 383/72 |

FOREIGN PATENT DOCUMENTS

| | | | |
|---|---|---|---|
| 0739297 | 7/1966 | Canada | 206/77.1 |
| 1914415 | 10/1970 | Fed. Rep. of Germany | 206/77.1 |
| 0516430 | 2/1955 | Italy | 206/77.1 |

*Primary Examiner*—Jimmy G. Foster

*Attorney, Agent, or Firm*—Burke-Robertson, Chadwick & Ritchie

[57] ABSTRACT

A water pervious bag for holding a bar of soap for washing a person's body, the bag comprising a sleeve of synthetic yarn, the yarn being of circular cross-section and knitted with a wide, loose weave, the bag being closed at one end and open at the other, and having releasable closing means at said other end.

16 Claims, 1 Drawing Sheet

SOAP-HOLDING BAG

The present invention relates to a device for holding soap, and more particularly to a bag which will hold a bar of soap for washing a person's body.

BACKGROUND OF THE INVENTION

Once such a bar has been wetted, it becomes soft and mushy and may readily disintegrate, for example if left on a wet surface for a period of time. It is thus desirable after using a bar of soap to place it on a dry surface.

It is known, to facilitate one's washing with a bar of soap, to insert that bar in a pocket inside a sponge so that a lather can be generated by the sponge when wetted while the sponge is rubbed on a person's body. With such an arrangement however, unless the soap is removed from the sponge after each washing and placed on a dry surface, the soap may become soft and disintegrate from the wetness of the sponge surrounding the soap in the pocket. As well, only limited amounts of lather are generated by the sponge.

Other references of background interest are Canadian Patent No. 487,572 of Cameron issued Oct. 28, 1952 and Canadian Patent No. 807,873 of Gropper issued Mar. 11, 1969, both of which describe scouring pads for cleaning, for example, pots and pans. The pads are constructed from loosely woven ribbon or flat fibre so that they are pervious to water and have sharp edges to scrape off dirt adhering to such pots and pans. Gropper additionally teaches incorporating a porous sponge within the pad to facilitate retaining suds and soap for distribution through the pad.

It is an object of the present invention to provide a pervious bag for holding a bar of soap to facilitate its drying after use. It is a further object of the present invention to provide such a bag which will encase the soap yet at the same time assist in generating lather and gently but abrasively scrubbing one's body.

SUMMARY OF THE INVENTION

In accordance with the present invention there is provided a water pervious bag for holding a bar of soap or the like for washing a person's body. The bag comprises a sleeve of synthetic yarn of circular cross-section knitted with a wide, loose weave. The bag is closed at one end and open at the other, having a releasable closing means at said other end.

In a preferred embodiment of the present invention, the bag is formed from a knitted sleeve doubled back on itself to produce a double wall. As well, a drawstring formed from a continuous loop is threaded through the bag at the end of the bag opposite from the closed end to releasably close this other end of the bag.

Soap contained in a bag in accordance with the present invention enables the soap to be rested in a position elevated from water on a surface or to be hung, for example, from a bathtub tap handle or faucet or the like, to assist in drying the soap. As well, the loose weave and round cross-section of the fibre forming the bag produces a surface which is mildly abrasive and which produces soap suds to facilitate scrubbing clean one's body.

BRIEF DESCRIPTION OF THE DRAWINGS

These and other objects and advantages of the invention will become apparent upon reading the following detailed description and upon referring to the drawings in which.

Figure 1:
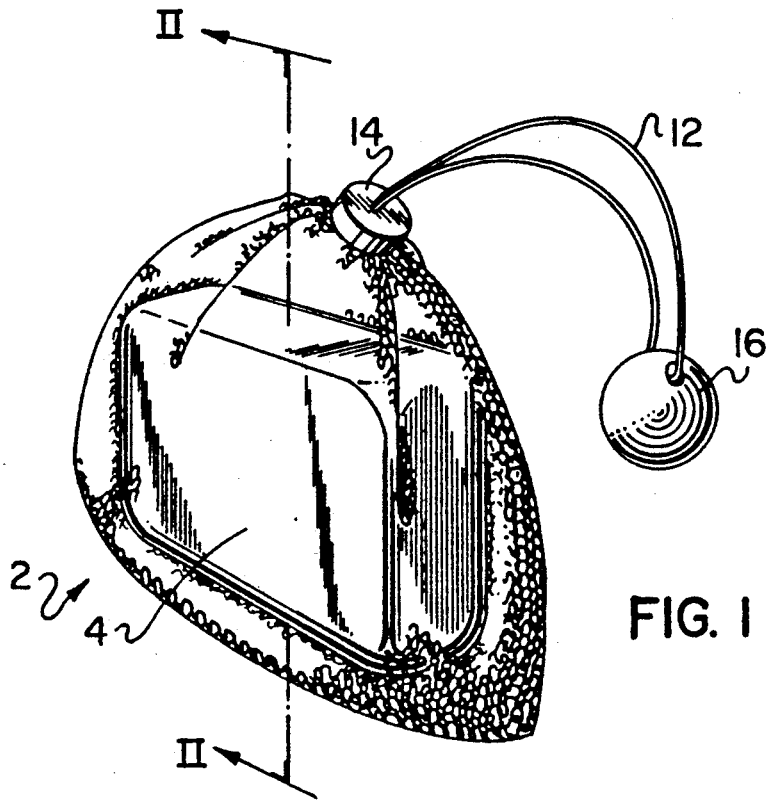
FIG. 1 is a perspective view of an example embodiment of a soap bag in accordance with the present invention.

While the invention will be described in conjunction with an example embodiment, it will be understood that it is not intended to limit the invention to such embodiment. On the contrary, it is intended to cover alternatives, modifications and equivalents as may be included within the spirit and scope of the invention as defined by the appended claims.

DETAILED DESCRIPTION OF THE DRAWINGS

In the drawings, similar features have been given similar reference numerals.

Figure 2:
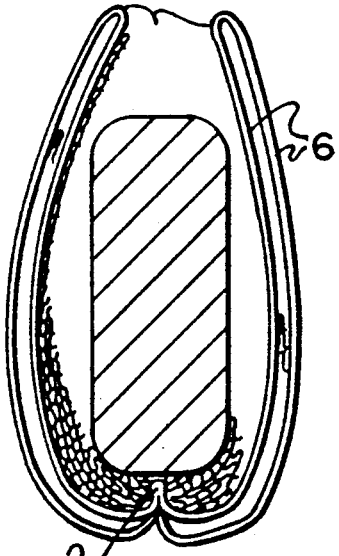
FIG. 2 is a cross-section view along line II—II of FIG. 1.
Figure 3:
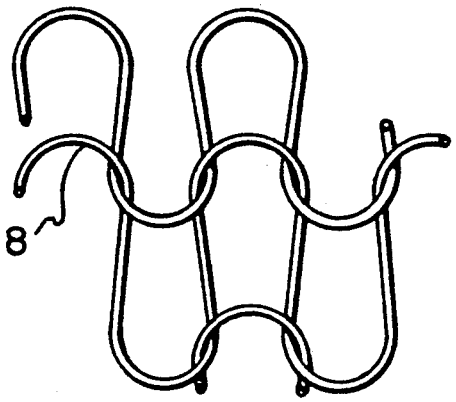
FIG. 3 is an enlarged view of a portion of the bag of the present invention illustrating the fibre and weave from which it is made.

Turning to FIG. 1, there is illustrated a bag 2 holding a bar 4 of soap in accordance with the present invention. As can be seen in FIGS. 2 and 3, bag 2 has double walls 6 and is formed from a loose weave of a yarn 8 of circular cross-section. Yarn 8 is of a soft synthetic material such as nylon and may be, for example, made of 0.009 inch diameter mono-filament nylon yarn. Bag 2 is formed for example by knitting a sleeve of appropriate length from yarn 8, doubling the sleeve back on itself to form the double wall 6, and closing the end 10 (preferably that having four free ends), for example by heat sealing or stitching.

The other end is releasably closeable by means of a drawstring loop 12 (for example made of nylon filament 0.025 inch in diameter), threaded through the weave at the open end of the sleeve. A disc 14, for example made from rubber, is slidably mounted on loop 12, with opposite sides of loop 12 passing centrally through disc 14, so that disc 14 may be slid towards bag 2 to bunch the knitted loops of yarn 8 at the open end of bag 2. Disc 14 is frictionally held at this position on loop 12 and thereby holds the open end of bag 2 closed. When disc 14 is moved away from bag 2, so that the loops of yarn 8 are no longer constricted on loop 12, at the open end of bag 2, this permits the opening of the bag.

A portion of the loop 12, on the side of disc 14 away from bag 10, is threaded through a large bead 16 or other such means to assist in spreading loop 12 to facilitate its handling, for example for when it is slipped over a water tap handle or faucet to be hung for drying a bar of soap held within.

In use, bag 2 is pervious to water. Its double wall and loose knit construction is extremely efficient in producing a foamy lather from soap held within, when the soap is wetted in water. The round cross-section of the yarn and its softness makes it safe and comfortable to use on a person's body while at the same time provides an invigorating abrasiveness. The abrasive nature of the bag makes it extremely effective for cleaning away dirt, dead skin, etc. When one is through using the bag, it may be easily hung to be drip dried. Because the soap then does not become mushy and disintegrate, its life is thereby extended. As well, many small pieces of soap may be carried in the bag to extend their use.

Thus it is apparent that there has been provided in accordance with the invention a bag for holding a soap bar that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A water pervious bag for holding a bar of soap for washing a person's body, the bag comprising a sleeve of synthetic yarn formed from a knitted sleeve doubled back on itself to produce a double wall, the yarn being of circular cross-section and knitted with a wide, loose weave, the bag being closed at one end and open at the other, and having releasable closing means at said other end.

2. A bag according to claim 1 made of soft nylon.

3. A bag according to claim 2 wherein the nylon is about 0.009 inch diameter nylon filament yarn.

4. A bag according to claim 1 wherein the four ends of the sleeve, when doubled back are heat sealed together to close the corresponding end of the bag.

5. A bag according to claim 4 wherein a drawstring forming a continuous loop is threaded through the bag at the open end to releasably close this end of the bag.

6. A bag according to claim 5 wherein a portion of the drawstring loop outside of the bag passes through a bead to facilitate keeping a portion of the drawstring loop near the bead spread apart.

7. A bag according to claim 5 wherein a stop means is slidably positioned on the loop, the stop means being slidable towards the bag to constrict the opening of the bag on the loop and thereby releasably close this open end of the bag.

8. A bag according to claim 1 wherein a drawstring forming a continuous loop is threaded through the bag at the open end to releasably close this open end of the bag.

9. A bag according to claim 8 wherein a portion of the drawstring loop outside of the bag passes through a bead to facilitate keeping a portion of the drawstring loop near the bead spread apart.

10. A bag according to claim 8 wherein a stop means is slidably positioned on the loop, the stop means being slidable towards the bag to constrict the opening of the bag on the loop and thereby releasably close this open end of the bag, the stop means being positioned on the loop between the bead and the bag.

11. A bag according to claim 10 is a rubber disk, the opposite sides of the loop passing through a small central apperature in the disc.

12. A water pervious bag for holding a bar of soap or the like for washing a person's body, the bag comprising a sleeve of synthetic yarn, the yarn being of circular cross-section and knitted with a wide, loose weave, the bag closed at one end and open at the other end having releasable closing means at the other, in combination with a bar of soap contained within the bag.

13. A bag according to claim 12 formed from a knitted sleeve doubled backed on itself to produce a double wall.

14. A bag according to claim 13 wherein the four ends of the sleeve, when doubled back are heat sealed together to close the corresponding end of the bag.

15. A bag according to claim 14 wherein a drawstring forming a continuous loop is threaded through the bag at the open end to releasably close this open end of the bag.

16. A bag according to claim 15 wherein a portion of the drawstring loop outside of the bag passes through a bead to facilitate keeping a portion of the drawstring loop near the bead spread apart.

* * * * *